US006314928B1

(12) United States Patent
Baraszu et al.

(10) Patent No.: US 6,314,928 B1
(45) Date of Patent: Nov. 13, 2001

(54) ROCKER ARM ASSEMBLY

(75) Inventors: Daniel James Baraszu, Plymouth; George Aristidis Papaioannou, Livonia, both of MI (US); Peter Renny George, West Chester, OH (US); Satheesh Makkapati, Belleville; Steve Poe, Canton, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/731,371

(22) Filed: Dec. 6, 2000

(51) Int. Cl.[7] ..... F01L 1/18; F01L 13/00; F02D 13/06

(52) U.S. Cl. ..... 123/90.16; 123/90.41; 123/198 F; 74/559

(58) Field of Search ..... 123/90.15, 90.16, 123/90.27, 90.39, 90.41, 90.42, 90.43, 90.44, 198 F; 74/519, 559

(56) References Cited

U.S. PATENT DOCUMENTS

| | | | | |
|---|---|---|---|---|
| 4,203,397 | * | 5/1980 | Soeters, Jr. | 123/90.16 |
| 4,612,887 | * | 9/1986 | Yoshizaki | 123/198 F |
| 5,524,580 | * | 6/1996 | Muir | 123/90.16 |
| 5,529,033 | | 6/1996 | Hampton | 123/90.16 |
| 5,544,626 | | 8/1996 | Diggs et al. | 123/90.16 |
| 5,615,647 | * | 4/1997 | Nielsen | 123/90.16 |
| 5,619,958 | * | 4/1997 | Hampton et al. | 123/90.16 |
| 5,623,897 | * | 4/1997 | Hampton et al. | 123/90.16 |
| 5,653,198 | | 8/1997 | Diggs | 123/90.16 |
| 5,655,488 | | 8/1997 | Hampton et al. | 123/90.16 |
| 5,660,153 | * | 8/1997 | Hampton et al. | 123/90.16 |
| 5,682,847 | * | 11/1997 | Hara | 123/90.16 |
| 5,682,848 | | 11/1997 | Hampton et al. | 123/90.16 |
| 5,690,066 | * | 11/1997 | Hampton et al. | 123/90.16 |
| 5,960,755 | | 10/1999 | Diggs et al. | 123/90.15 |

* cited by examiner

*Primary Examiner*—Wellun Lo
(74) *Attorney, Agent, or Firm*—Carlos Hanze

(57) ABSTRACT

The lost motion arm 44 has first and second contact surfaces 102 and 104. A latch mechanism is connected on the body with an extendable plunger 120 having a first contact surface 124 and a second contact surface 126. The plunger 120 has a first position for first contact surface 124 engagement with the lost motion arm first contact surface 102 to prevent angular movement of the lost motion arm 44 with respect to the body 10 in a first angular direction. When angular movement in the first angular direction is prevented, the motion of the lost motion arm 44 imparted by the cam lobe 66 is transmitted to the body 10 to provide for a first state of operation of the valve stem 18. When the plunger 120 is in a second position, non-contacting with the lost motion arm 44, the lost motion arm 44 is allowed to pivot relative to the body 10. Accordingly, the rocker arm assembly 7 will be in a second state of total or partial deactivation of the valve stem 18. The plunger second contact surface 126 contacts with the lost motion arm second contact surface 104 to cause the plunger 120 to be cammed out of the first position when the plunger 120 is in the first position and when the plunger first contact surface 124 is not engaged with the lost motion arm's first contact surface 102.

12 Claims, 5 Drawing Sheets

ROCKER ARM ASSEMBLY

FIELD OF THE INVENTION

The field of the present invention is that of rocker arm assemblies for internal combustion engines. More particularly, the field of the present invention is that of rocker arm assemblies for internal combustion engines which can be selectively deactivated to totally or partially deactivate a combustion chamber valve of an internal combustion engine.

BACKGROUND OF THE INVENTION

Rocker arms transmit motion from a rotating cam shaft to a stem of a poppet valve to open and close the valve. Almost universally, the valve is spring-biased shut and the cam via the rocker arm controls the opening and closing of the valve. One type of rocker arm is the finger follower rocker arm.

In recent times, rocker arms have been made to selectively deactivate to allow enhanced control of vehicle engines in regard to emissions and fuel economy. In one such rocker arm assembly, the rocker arm 23 (FIG. 9) has an outer body 25 that engages the valve stem (not shown) and an inner lost motion arm 27 pivotally mounted on and within the outer body for movement relative to the outer body. The lost motion arm 27 is spring-biased upward against an overhead engine cam lobe (not shown) to be pivoted by the same. A latching mechanism with an extendable plunger 29 is positioned within the outer body 25. The plunger 29 is normally in a position to limit movement of the lost motion arm 27 relative to the outer body 25 so that the cam lobe can pivot the outer body 25 and lost motion arm 27 together as an integral unit to activate the valve stem. Withdrawal of the latch mechanism plunger 29 allows the lost motion arm 27 to freewheel in a lost motion manner without causing any partial or full movement of the outer body 25 and valve stem.

Currently, such selectively deactivation rocker arm assemblies are valve lift limited due to a condition termed "super submarining" (hereinafter referred to as submarining) wherein the rocker arm assembly is permanently locked in a valve deactivated condition. Submarining occurs when the lost motion arm is inadvertently held underneath an extended plunger 29. Submarining causes the cylinder serviced by the submarining rocker arm 23 to be permanently disabled. When the submarining occurs, major disassembly of the vehicle engine is required to alleviate the situation. Prior to the present invention, the valve lift and engine speed have been compromised by limiting them to such levels so as to prevent the lost motion control arm 27 from passing below the plunger 29. It is desirable to provide a rocker arm assembly which is self-alleviating from any potential submarining conditions.

SUMMARY OF THE INVENTION

To make manifest the above delineated desire, the revelation of the present invention is brought forth. The rocker assembly of the present invention provides for selective deactivation of a valve while providing a freedom of engine design to maximize valve lift and engine speed. In a preferred embodiment, the rocker arm assembly of the present invention provides a longitudinal extending body. The body is engagable adjacent a first end with an engine valve stem to activate the same. Opposite the first end, the body is engagable with a pivot fulcrum. A lost motion arm is provided. The lost motion arm is pivotally connected to the first end of the body. The lost motion arm is spring biased by torsion springs into engagement with a rotatable cam lobe of the engine. The lost motion arm has first and second contact surfaces. A latch mechanism is connected on an end of the body generally opposite the pivotal connection of the lost motion arm with the body. The latch mechanism includes an extendable plunger with first and second contact surfaces. The plunger has a first position for first contact surface engagement with the lost motion arm first contact surface to prevent angular movement of the lost motion arm with respect to the body in a first angular direction. When angular movement in the first direction is prevented, the motion of the lost motion arm imparted by the cam to be transmitted to the body to provide for a first state of activation of the valve stem. When the plunger is in a second position, non-contacting with the lost motion arm, the lost motion arm is allowed to pivot relative to the body. Accordingly, the rocker arm assembly will be in a second state of total or partial deactivation of the valve. Additionally, the plunger has a second contact surface for contact with the lost motion arm second contact surface to cause the plunger to be cammed out of the first position when the plunger is in the first position and wherein the plunger first contact surface is not engaged with the lost motion arm's first contact surface.

It is a feature of the present invention to provide a selectively deactivatable rocker arm assembly that is self-relieving from a submarining condition.

Other features of invention will become more apparent to those skilled in the art from a reading of the following detailed description and upon reference to the drawings.

DETAILED DESCRIPTION OF THE INVENTION

FIGS. 1 through 8 illustrate an internal combustion engine rocker arm assembly 7 according to the present invention.

Figure 1:
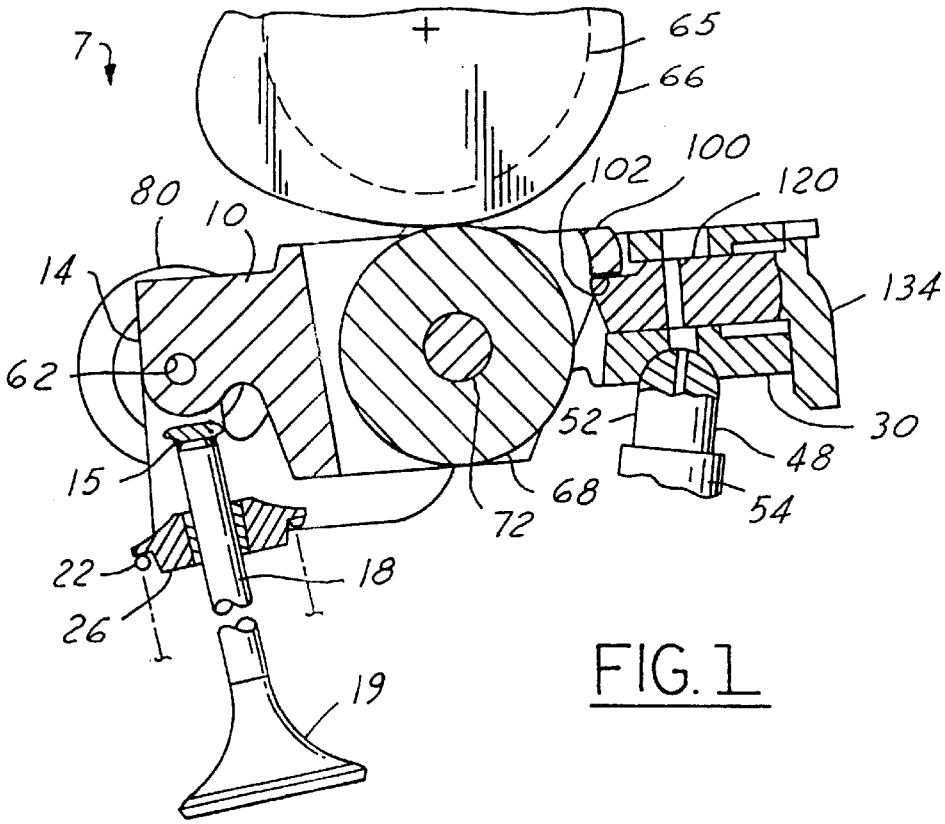
FIG. 1 is a sectional view of a preferred embodiment rocker arm according to the present invention.
Figure 8:
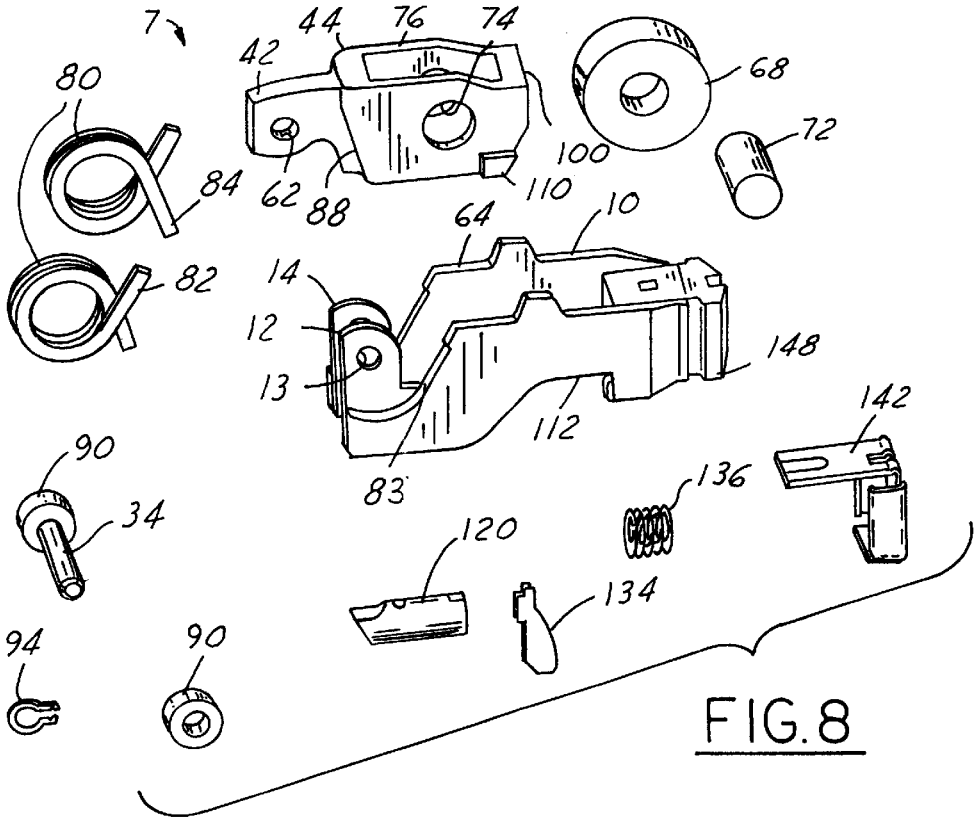
FIG. 8 is an exploded view illustrating the various parts of the rocker arm assembly shown in FIG. 1.

The rocker arm assembly 7 has a body 10 which is often referred to as a cradle or outer arm. The body has twin ears 12, the ears 12 have a transverse bore 13 (FIG. 8). The body 10 has a first end 14. The body first end 14 as best shown in FIG. 1 is engagable with a valve stem 18 via a convex contact surface 15 (only partially shown) of the body 10 for activation of a poppet valve 19. The valve stem 18 is biased generally upward by a spring 22 which captured by a valve stem collar 26. The upward biasing of the valve stem 18 places the valve 19 in a closed position to prevent fluid communication through a port to a combustion chamber (not shown) of the engine. To open the poppet valve, the body first end 14 will pivot in a generally counter-clockwise direction.

The body 10 has an opposite second end 30. The second end 30 is engagable with a pivot fulcrum 48. The pivot fulcrum 48 is provided by a plunger portion 52 of a hydraulic lash adjuster 54. As better shown in FIG. 3, the body second end 30 has a spherical socket 58 receiving the plunger 52. The lash adjuster 54 constitutes a stationary fulcrum for pivotal movement of the body 10 of the rocker arm assembly in a manner to be described.

An inner arm or lost motion arm 44 is pivotally connected to the first end 14 of the body 10. A pin 34 passes through bores 13 and 62 (as best shown in FIG. 8). A lever end 42 of the lost motion arm is pivotally connected by the pin 34. The lost motion arm 44 fits in between the yokes 64 of the body (FIG. 8). The lost motion arm 44 is spring biased arcuately in a counter-clockwise direction as shown in FIG. 1 to have contact with a rotatable cam lobe 66. The cam lobe 66 is rotated by a cam shaft (not shown) which is powered by the engine. To make contact with the cam lobe 66, the lost motion arm 44 has a roller 68. The roller 68 is rotatably connected to the lost motion arm 44 via a pin 72 which is mounted within a bore 74 of parallel front extending fingers 76 of the lost motion arm 44. The lost motion arm 44 is spring biased into the cam lobe 66 by coil torsion springs 80. The coil torsion springs 80 have a first leg 82 which pushes against ramps 83 of the body. The springs 80 also have a second leg 84 which interacts with incline surface 88 of the lost motion arm to urge it in a previously mentioned counter-clockwise direction. The springs 80 encircle the pin 34 and are mounted on the dual heads 90 of the pin. The heads 90 are held in position on the pin 34 by a retention washer 94.

Figure 5:
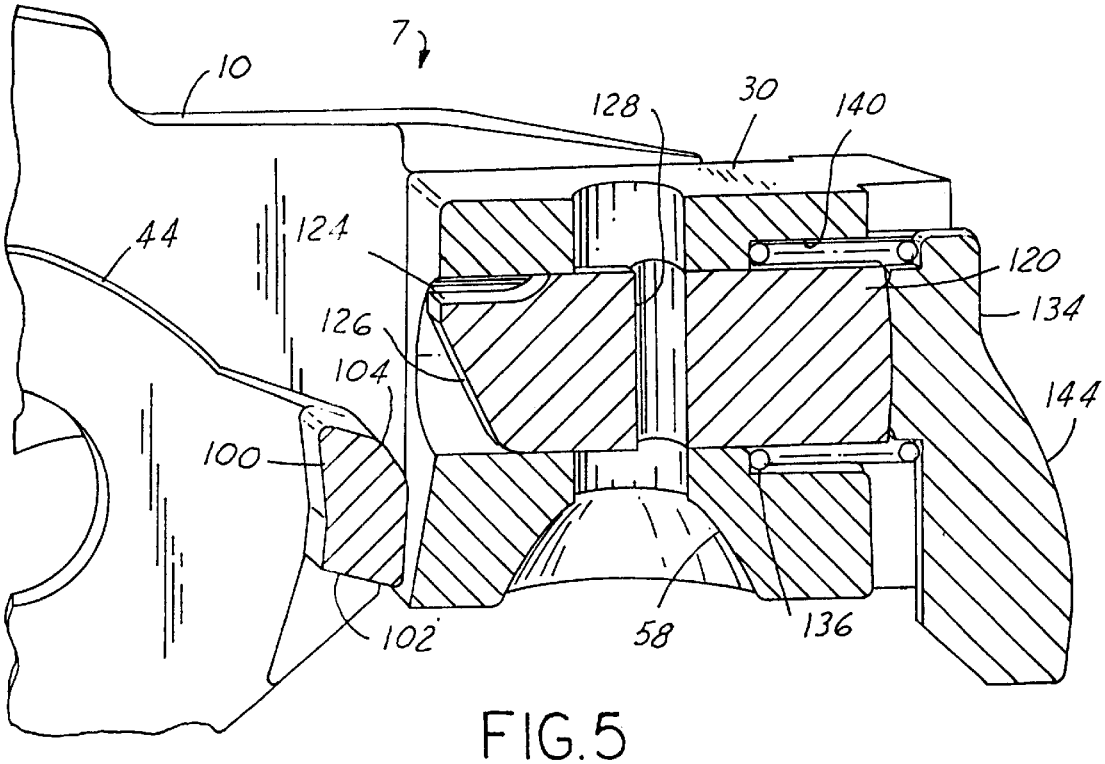
FIG. 5 is a partial sectional view similar to that of FIG. 3, illustrating the lost motion arm of the rocker arm assembly in the lowered position non-engaging with the plunger of the latch mechanism.
Figure 6:
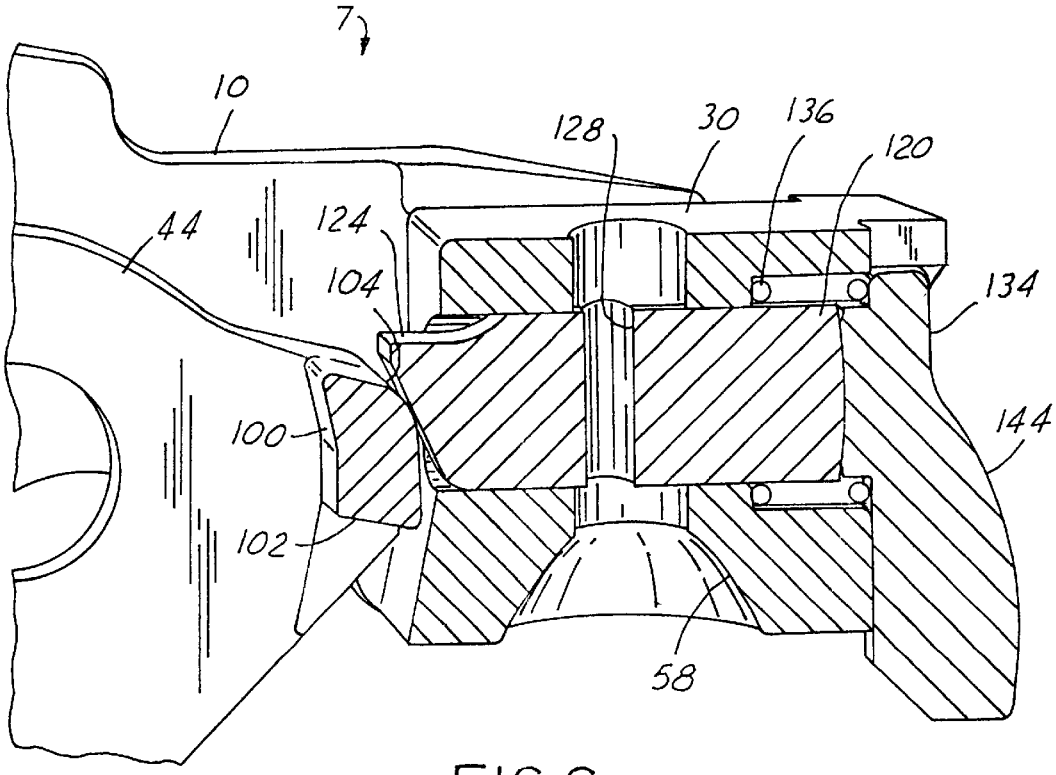
FIG. 6 is a partial sectional view of the rocker arm assembly similar to that of FIG. 5, illustrating the anti-submarining characteristics of the present inventive rocker arm assembly.

The fingers 76 of the lost motion arm have extending between them a bridge 100. The bridge 100 along its bottom end has a first contact surface 102. The bridge 100 as best shown in FIGS. 5 and 6, also has a second cam contact surface 104. The lost motion arm 44 also has a lateral stud projection 110 which limits its extreme counter-clockwise angular movement with respect to the body 10 by contact with a lower surface 112 of the body.

Figure 3:
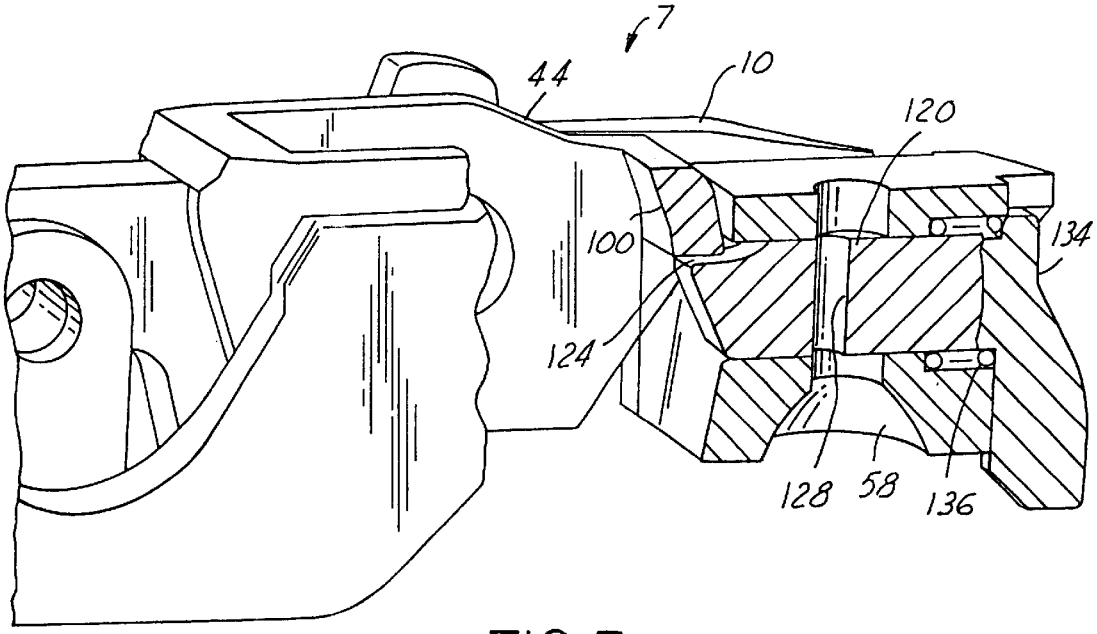
FIG. 3 is a partial sectional view of the rocker arm assembly as shown in FIG. 2, with a plunger of a latch mechanism engaging a lost motion arm.
Figure 4:
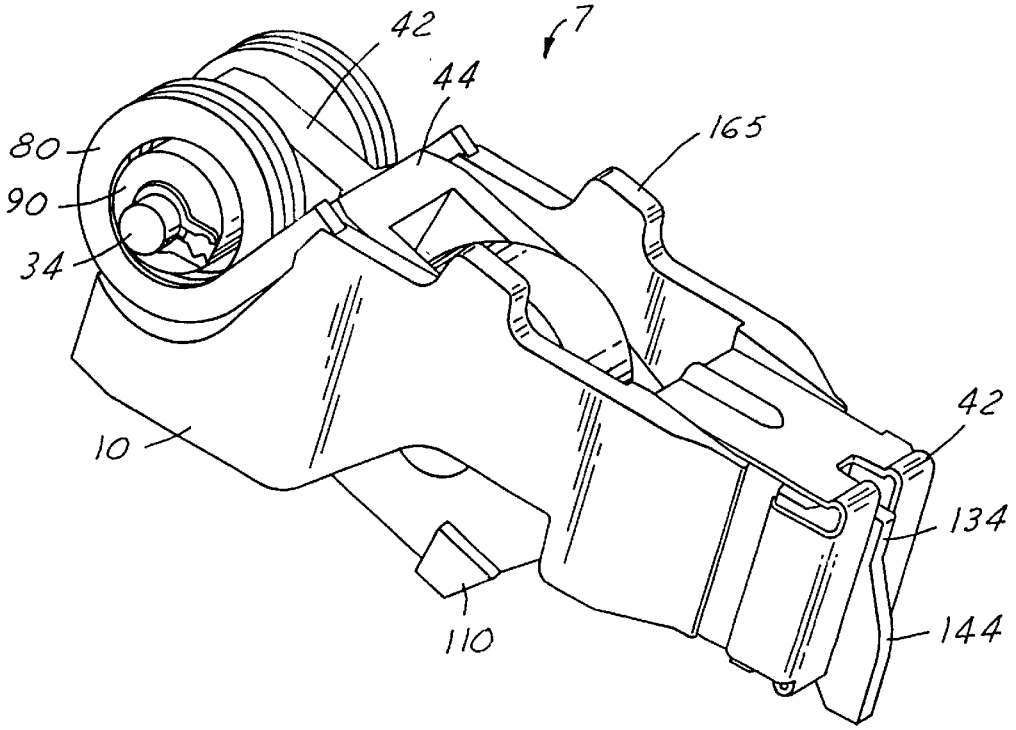
FIG. 4 is an enlarged perspective view similar to FIG. 2, illustrating the lost motion arm of the rocker arm in a lowered position.

The second end 30 of the body also has a latch mechanism. The latch mechanism includes an extendable plunger 120. The plunger 120 has an upper first contact surface 124. The plunger 120 also has a transverse bore 128 to allow for the cumulative flow of lubricating oil therethrough. The plunger 120, as shown in FIG. 3, has a first position wherein its first contact surface 124 is contacting with the first contact surface 102 of the lost motion arm bridge 100. In the first position as shown in FIG. 3, the plunger 120 prevents relative angular motion of the lost motion arm 44 with respect to the body 10 in a clockwise direction. The plunger 120, as best shown in FIG. 5, has a second position which is non-contacting with the lost motion arm bridge 100 to allow the lost motion arm 44 to pivot clockwise relative to the body 10.

Figure 2:
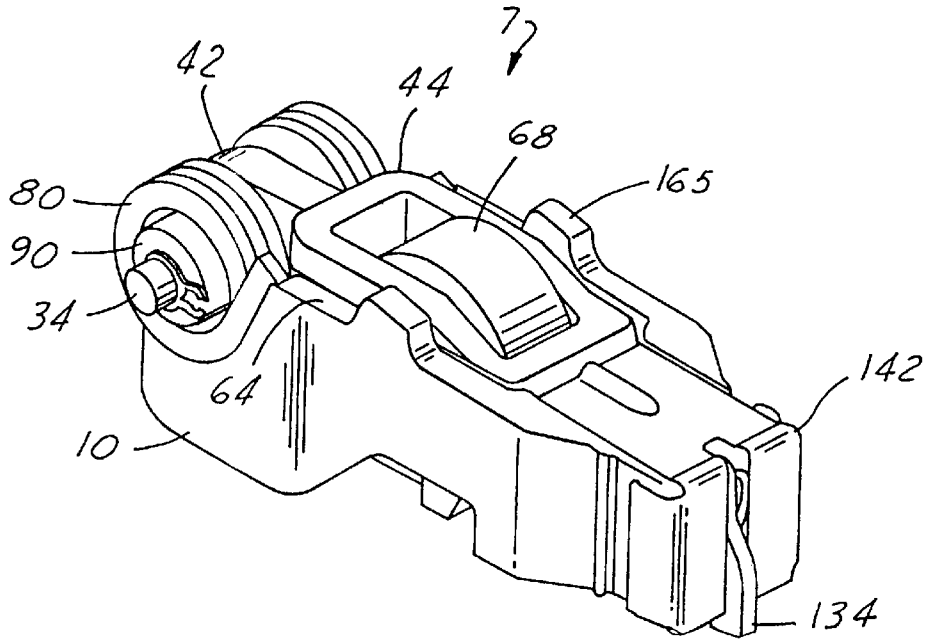
FIG. 2 is a perspective view of a rocker arm assembly shown in FIG. 1.

The plunger 120 has fixably connected thereto a latch pin 134 shown separated from the plunger 120 in FIG. 8. A spring 136 encircles the plunger 120 in its position within a bore of the body 10. The spring 136 urges the latch pin 134 to the right, as shown in FIG. 5, to position the plunger 120 in its aforementioned second position. The plunger 120 is held to the body 10 by a latch pin retainer 142, as best shown in FIGS. 2 and 8. The latch pin retainer 142 clips onto a transverse ledge 148 of the body.

An activating system (FIG. 7) includes an axle or shaft 180 rotatable by a solenoid 184. The activating system further includes at least one activating arm 188 disposed about and extending radially from the shaft 180 to engage or disengage the latch pin 134. The activating arm 188 has a contact surface which mates and contacts with a cylindrical surface 144 of the latch pin. The activating arm 188 is urged into engagement with the latch pin 134 by a helical coil spring 192 disposed about the activator shaft 180. In such situations, the latch pin 134 and plunger 120 will be in a position as shown in FIG. 3 compressing the spring 136. When it is desirable for the plunger 120 to assume its position as shown in FIG. 5, the engine control unit will supply power to the activator solenoid 184 to cause the activating arm 188 to rotate away from the latch pin 134 to allow the spring 136 to move the plunger 120 to its second position.

In operation, typically the plunger 120 will be in the position shown in FIG. 3. In its first position, the plunger first contact surface 124 makes contact with the lost motion arm bridge first contact surface 102. Accordingly, the lost motion arm 44 is now limited in its movement clockwise with respect to the body 10. In a first state of activation, rotation of the cam lobe 66 causes the lost motion arm 44 and the cam body to pivot about the fulcrum provided by the lash adjustor 54 and accordingly rotate as a unit in a counter-clockwise direction about the lash adjustor fulcrum to cause the contact surface 15 to push downward on the valve stem 18 to open the valve 19. Upon further rotation of the cam lobe 66, the unit of the lost motion arm 44 and the body 10 will rotate back in a clockwise position, therefore allowing the upward movement of the valve stem 18 to close the valve 19.

When it is desired to go to a second state of deactivation of the valve 19, the engine control module will activate the solenoid 184 (FIG. 7) to move the activator arm 188 away from the latch pin 134. Accordingly, the spring 136 will move the plunger 120 to a position as shown in FIG. 5. The lost motion arm 44 by virtue of its contact with the rotating cam 66 can now have clockwise annular movement with respect to the body 10 and activation of the valve 19 will cease. If it is desirable to utilize the deactivation (second state) feature of the rocker arm assembly 7 to provide a shorter duration of activation of the valve 19, the cam shaft (not shown) may on either side or both sides of the rotating cam lobe 66 have another lobe 65 (shown in phantom in FIG. 1) which can engage with pads 165 of the body to give a short duration operation as best explained in commonly assigned U.S. Pat. No. 5,960,755, Diggs, issued Oct. 5, 1999. If the lobe 65 and pads 165 are eliminated, the second state of deactivation will be similar to that described in U.S. Pat. No. 5,653,198 Diggs issued Aug. 5, 1997, wherein the valve 19 is completely deactivated. The disclosures of both aforementioned patents are incorporated by reference herein.

Referring to FIG. 6, in cases wherein the lost motion arm 44 is submarined underneath the plunger 120, the lost motion bridge curvilinear second cam surface 104 will engage the second surface 126 of the plunger and cause the plunger 120 to be pushed rearwardly restoring it to its second position as shown in FIG. 5. The motion of the plunger 120 and its connected latch pin 134 will be against the spring 192. The plunger 120 will be pushed back to its first position as shown in FIG. 5. After the lost motion arm pivots upward, the spring 192 will return the plunger to the first position as shown in FIG. 3. The first contact surface of the bridge 102 will again be placed on top of the first contact surface 124.

Figure 10:
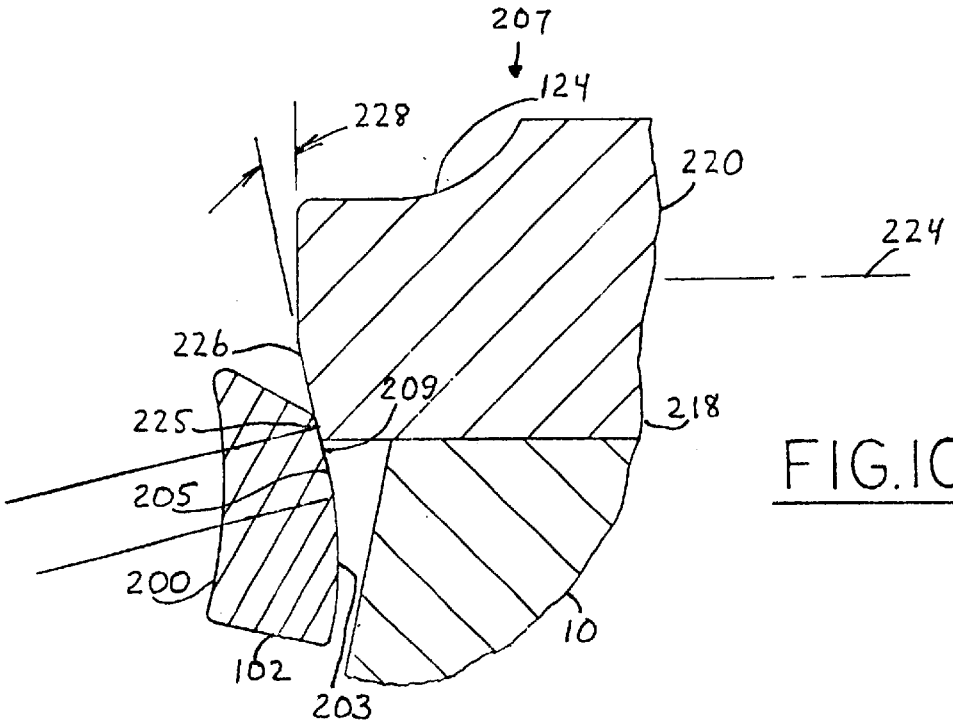
FIG. 10 is an enlarged partial sectional view of an alternate preferred embodiment rocker arm assembly according to the present invention.

Referring to FIG. 10, an alternate preferred embodiment rocker arm assembly 207 is shown in an enlarged partial section which extends between the lost motion arm bridge 200 and the plunger 220. The plunger 220 is slidably fitted within a longitudinal bore 218 of the body 10 in a manner as previously described. The plunger has a first contact surface 124 as previously described. The plunger 220 has a second contact surface 226 which has an angle 228 with a line generally perpendicular to the longitudinal axis 224 of the plunger. Angle 228 will typically be 15 degrees, plus or minus 3 degrees. The bridge 200 of the lost motion control arm has a first contact surface 102 substantially similar as previously described. The first contact surface has an upper end 225 which has a slight curvature to prevent gouging into the second contact surface 226 of the plunger. The second contact surface further includes a generally planar or flat section 205. The flat 205 blends into a curvilinear portion 203.

Figure 7:
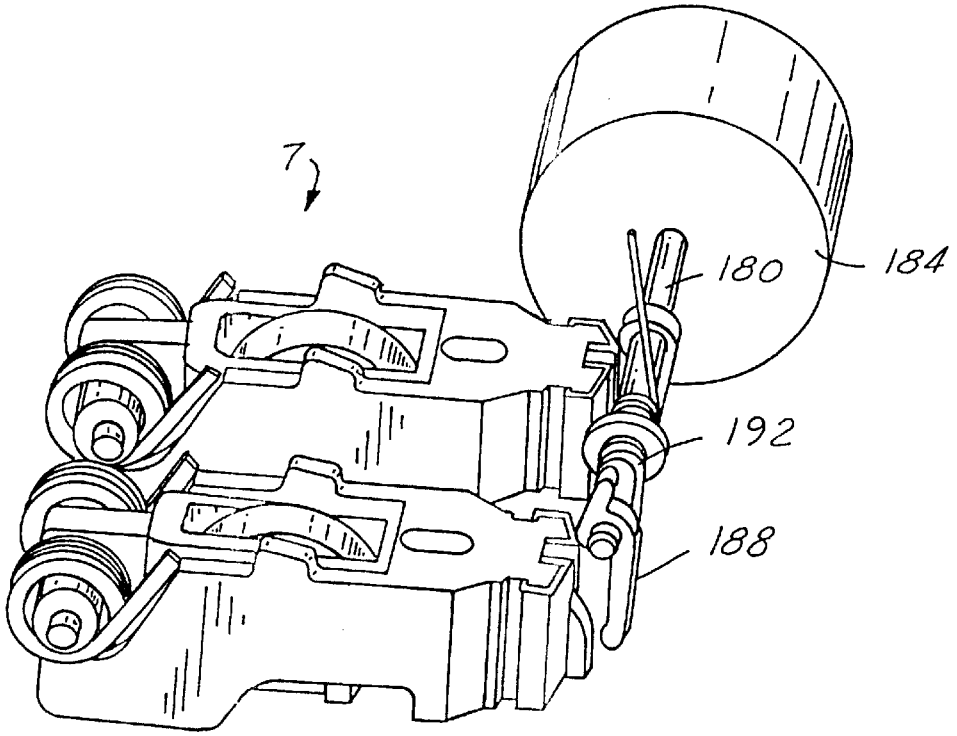
FIG. 7 is a perspective view of two rocker arm assemblies according to the present invention installed in an engine.
Figure 9:
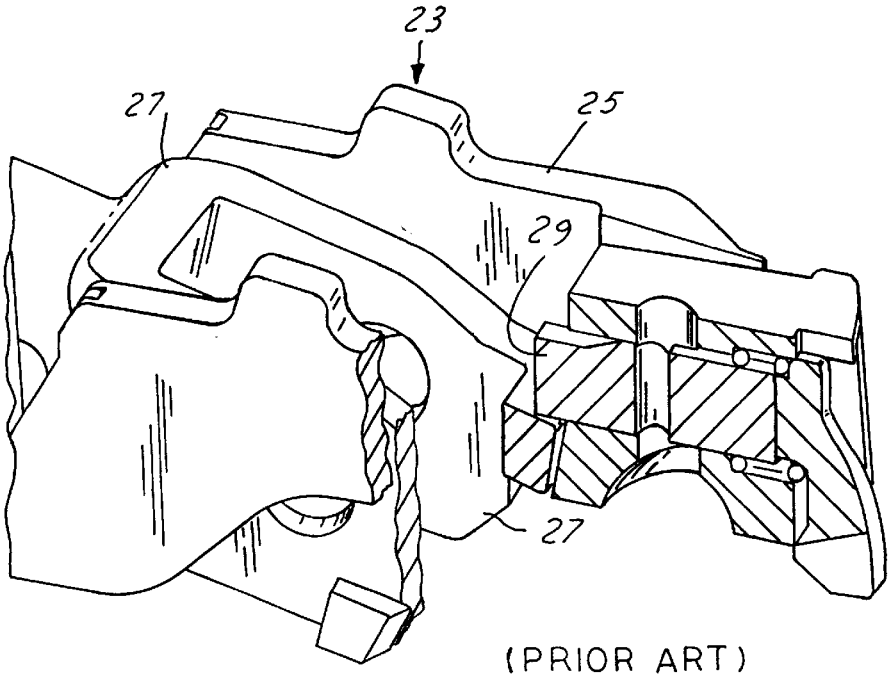
(PRIOR ART) FIG. 9
FIG. 9 is a sectional view similar to that of FIG. 6, illustrating the submarining problem of prior art rocker arm assemblies.

The rocker arm assembly 207 in the first position as shown in FIG. 10, always has its extreme lower end 209 extending from the bore 218 when the plunger 220 is in the first position. Extension out of the bore 218 of the plunger prevents the extreme end 209 from stressing the body 10. The general flat section 205 of the second contact surface of the lost motion arm is configured to have initial generally parallel flat to flat engagement with the second contact surface 226. The flat to flat engagement helps protect the bridge 200 and the plunger 220 from excessive force transmission. It is worth noting that FIG. 9 is a substantial enlargement of the actual parts and the plunger can typically have a diameter of approximately 5 mm. Accordingly, due to the small relative size of these parts, avoidance of the excessive force transmittal is extremely important. The flat to flat engagement also diminishes the initial acceleration given to the plunger 220 by the second contact surface 205 of the lost motion arm bridge and accordingly excessive force transmittal from the plunger 220 to one of the engagement arms 188 as shown in FIG. 7, can be reduced or avoided. After the initial contact, the curvilinear contact surface 203 will engage with the second contact surface 226 of the plunger.

While preferred embodiments of the present invention have been disclosed, it is to be understood that they have been disclosed by way of example only and that various modifications can be made without departing from the spirit and scope of the invention as it is encompassed by the following claims.

We claim:

1. An engine rocker arm assembly comprising:

a body engagable adjacent a first end with valve stem for activation thereof, said body being engagable with a pivot fulcrum adjacent an end opposite said first end;

a lost motion arm pivotally connected to one of said ends of said body, said lost motion arm being spring biased into engagement with a cam lobe, said lost motion arm having first and second contact surfaces;

a latch connected on an end of said body generally opposite said pivotal connection of said lost motion arm with said body, said latch including an extendable plunger with first and second contact surfaces, said plunger having a first position for said plunger first contact surface engagement with said lost motion arm first contact surface to prevent angular movement of said lost motion arm with respect to said body in a first given angular direction to thereby transmit movement of said lost motion arm by said cam to said body for a first state of activation of said valve stem, and said plunger having a second position non-contacting with said lost motion arm to allow said lost motion arm to pivot relative to said body to activate said valve stem in a second state of deactivation of said valve stem and wherein said plunger second contact surface having contact with said lost motion arm second contact surface to cause said plunger to be cammed out of said first position when said plunger is in said first position and wherein said plunger first contact surface is not engaged with said lost motion arm first contact surface.

2. A rocker arm assembly as described in claim 1, wherein said second contact surface on said plunger is planer.

3. A rocker arm assembly as described in claim 1, wherein said second contact surface on said lost motion arm is curvilinear.

4. A rocker arm assembly as described in claim 2, wherein said second contact surface on said lost motion arm is curvilinear.

5. A rocker arm assembly as described in claim 1, wherein said lost motion arm is fitted between yokes of said body.

6. A rocker arm assembly as described in claim 1, wherein said lost motion arm has two extending fingers and said first and second contact surfaces are on a bridge between said extending fingers.

7. A rocker arm assembly as described in claim 1, wherein said extendable plunger is mounted within a bore in said body and said plunger in said first position has a lower extreme end which is extending out of said bore.

8. A rocker arm assembly as described in claim 1, wherein said plunger second contact surface is at a 15° angle with a line generally perpendicular with a longitudinal axis of said plunger, plus or minus 3 degrees.

9. A rocker arm assembly as described in claim 1, wherein said lost motion arm second contact surface has a flat along an upper end which blends into a curvilinear surface.

10. A rocker arm assembly as described in claim 1, wherein said lost motion arm second surface has a flat for initial general parallel contact with said plunger second contact surface.

11. An internal combustion engine rocker arm assembly comprising:

a longitudinally extending body engagable adjacent a first end with an engine valve stem for activation thereof, said body being engagable with a pivot fulcrum adjacent an end opposite said first end;

a lost motion arm pivotally connected to one of the ends of said body, said lost motion arm being spring biased into engagement with a rotatable cam lobe;

said lost motion arm having a first contact surface and a second contact surface, said second contact surface on an upper end having a generally flat section which blends into a curvilinear section;

a latch mechanism connected on an end of said body generally opposite said pivotal connection of said lost motion arm with said body, said latch mechanism including an extendable plunger mounted within a bore of said body, said plunger having a first upper contact surface and a second contact surface, said second contact surface making a general 15 degrees, plus or minus 3 degrees angle with a line perpendicular to a longitudinal axis of said plunger, said plunger having a first position with a lower end of said plunger extending out of said bore of said body for said plunger first contact surface engagement with said lost motion arm first contact surface to prevent angular movement of said lost motion arm with respect to said body in a first given angular direction to thereby transmit movement of said lost motion arm by said cam to said body for a first state of activation of said valve stem, and said plunger having a second position non-contacting with said lost motion arm to allow said lost motion arm to pivot relative to said body to activate said valve stem in a second state of deactivation of said valve stem; and wherein said plunger second contact surface having contact with said lost motion arm second contact surface to cause said plunger to be cammed out of said first position when said plunger is in said first position and wherein said plunger first contact surface is not engaged with said lost motion arm first contact surface and wherein said lost motion arm second contact surface general flat section makes general parallel flat initial engagement with said plunger second contact surface when camming said plunger out of said first position.

12. A method of alleviating a submarine condition of a selectively deactivatable rocker arm assembly wherein said rocker arm assembly has a body having a lost motion arm pivotally connected thereto and said body has an extendable latch plunger and wherein said plunger in a first position prevents angular movement of said lost motion arm relative to said body in a first direction by contact of a first contact surface of said plunger with a first contact surface of said lost motion arm and wherein in a second position said plunger allows relative angular movement of said lost motion arm with respect to said body, said method of alleviating a submarine condition comprising:

providing on said lost motion arm a second contact surface;

providing on said plunger a second contact surface; and contacting said lost motion arm second contact surface against said second contact surface of said plunger to cam said plunger from said first position to said second position when said lost motion arm second contact surface is submarined under said plunger and wherein said plunger is in said first position.

* * * * *